United States Patent [19]

Crookston et al.

[11] 4,358,648

[45] Nov. 9, 1982

[54] POWER CIRCUIT BREAKER WITH OPENING AND CLOSING MECHANISMS

[75] Inventors: Ronald W. Crookston, Penn Township, Westmoreland County; Hayes O. Dakin, Jr., North Huntingdon, both of Pa.

[73] Assignee: Westinghouse Electric Corp., Pittsburgh, Pa.

[21] Appl. No.: 171,931

[22] Filed: Jul. 18, 1980

[51] Int. Cl.[3] ..... H01U 33/28

[52] U.S. Cl. ..... 200/150 R; 200/148 R; 200/82 B

[58] Field of Search ..... 200/150 R, 148 R, 148 A, 200/148 F, 82 B

[56] References Cited

U.S. PATENT DOCUMENTS

| | | | |
|---|---|---|---|
| 2,436,194 | 2/1948 | Bush | 200/82 B |
| 4,251,701 | 2/1981 | Meyer | 200/148 A |
| 4,271,341 | 6/1981 | Meyer | 200/148 A |
| 4,275,431 | 6/1981 | Swoish et al. | 200/148 A |

*Primary Examiner*—Robert S. Macon
*Attorney, Agent, or Firm*—L. P. Johns

[57] ABSTRACT

A circuit breaker characterized by a pair of separable contacts, operating means for opening the contacts and comprising a cylinder and piston mechanism, closing means for closing the contacts and comprising a second cylinder and piston assembly operatively connected to the contacts.

9 Claims, 20 Drawing Figures

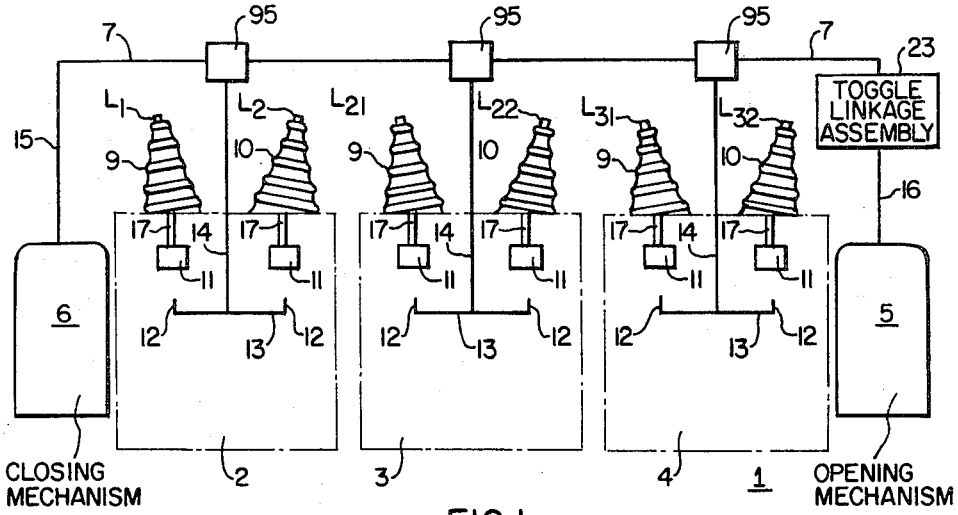
FIG. 1.
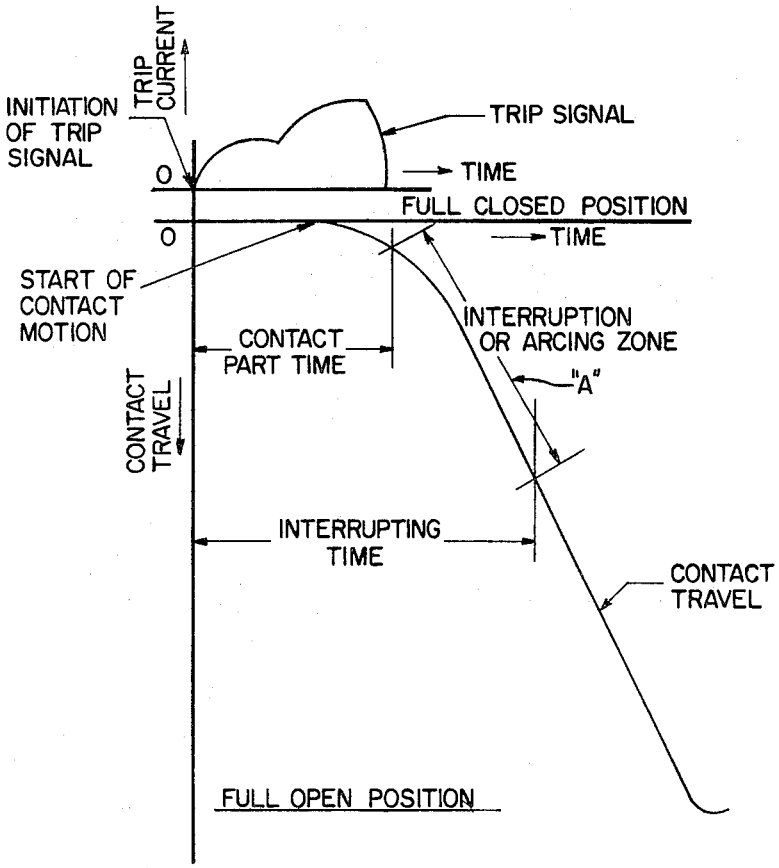
FIG. 14.
FIG. 20.
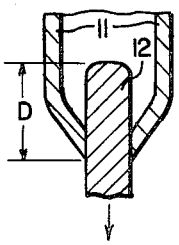

CLOSED POSITION OF CIRCUIT BREAKER 1

FULLY-OPEN
POSITION OF
CIRCUIT-BREAKER 1

POWER CIRCUIT BREAKER WITH OPENING AND CLOSING MECHANISMS

CROSS-REFERENCE TO RELATED APPLICATIONS

This application is related to a copending application of Thomas N. Meyer, Ser. No. 945,369, filed Sept. 25, 1978. (W.E. Case 45,451C)

BACKGROUND OF THE INVENTION

1. Field of the Invention

This invention relates to a power circuit breaker having separate means for opening and closing the contacts.

2. Description of the Prior Art

Propellant-type operators have been used to actuate the operating mechanism for circuit breakers. For example, reference is made to U.S. Pat. Nos. 2,096,619; 2,436,194; 2,476,024; 2,552,358; and 4,131,774.

Since circuit breakers of certain types involve the use of mechanical linkage, it is desirable to initiate movement of the system as soon as possible when an overcurrent occurs. When an overcurrent occurs, most mechanical devices for initiating the opening of the contacts have been inherently slow simply due to the time lost, or dwell time in applying forces once the signal to open occurs.

SUMMARY OF THE INVENTION

It has been found in accordance with this invention that improvements in opening as well as closing contacts of a power circuit breaker may be obtained by providing a circuit interrupter having a pair of separable contacts, opening means for opening the contacts and comprising a cylinder and piston mechanism, a solid propellant charge for expulsion of a gaseous medium into one end of the cylinder against the piston, the piston having a piston rod extending from the other end of the cylinder, operating means comprising a toggle lever having a pivot point and movable between latched and unlatched positions corresponding to closed and open positions of the separable contacts, a linkage extending between the contacts and the toggle lever and being connected to the toggle lever, an over-center toggle-spring assembly attached to the toggle lever for biasing the lever in the latched position, the piston rod and piston when actuated turning the toggle lever over center to the unlatched position, and closing means for the contacts comprising a cylinder-piston assembly operatively connected to the contacts and including a lever operatively connected to the cylinder-piston assembly. Associated with the foregoing is a magnetic latch used in conjunction with the generator means for ejection and reloading of solid propellant charges.

The advantage of the device of this invention is that it enables rapid unlatching of the over-toggle linkage and spring load and supplies opening energy. Separate means for closing the contacts in an effective manner is provided.

BRIEF DESCRIPTION OF THE DRAWINGS

FIG. 1 is a diagrammatic view of a three-phase high-power circuit breaker of the oil-break type employing features of the present invention, showing the contact structures in the fully open circuit position;

FIG. 14 is a graph of the contact position as a function of opening time, and illustrating the initial accelerating portion of the circuit breaker opening operation;

FIG. 20 is a fragmentary vertical sectional view of the contact overlap which must be overcome to reach "contact part".

DESCRIPTION OF THE PREFERRED EMBODIMENTS

In FIG. 1 a three-phase circuit interrupter of the high-power liquid-oil type is generally indicated at 1 and comprises three pole units 2, 3, and 4 together with an opening mechanism 5, a closing mechanism 6, and operating means generally indicated at 7 extending between the mechanisms 5, 6 for opening and closing the pole units 2, 3, and 4.

Figure 2:
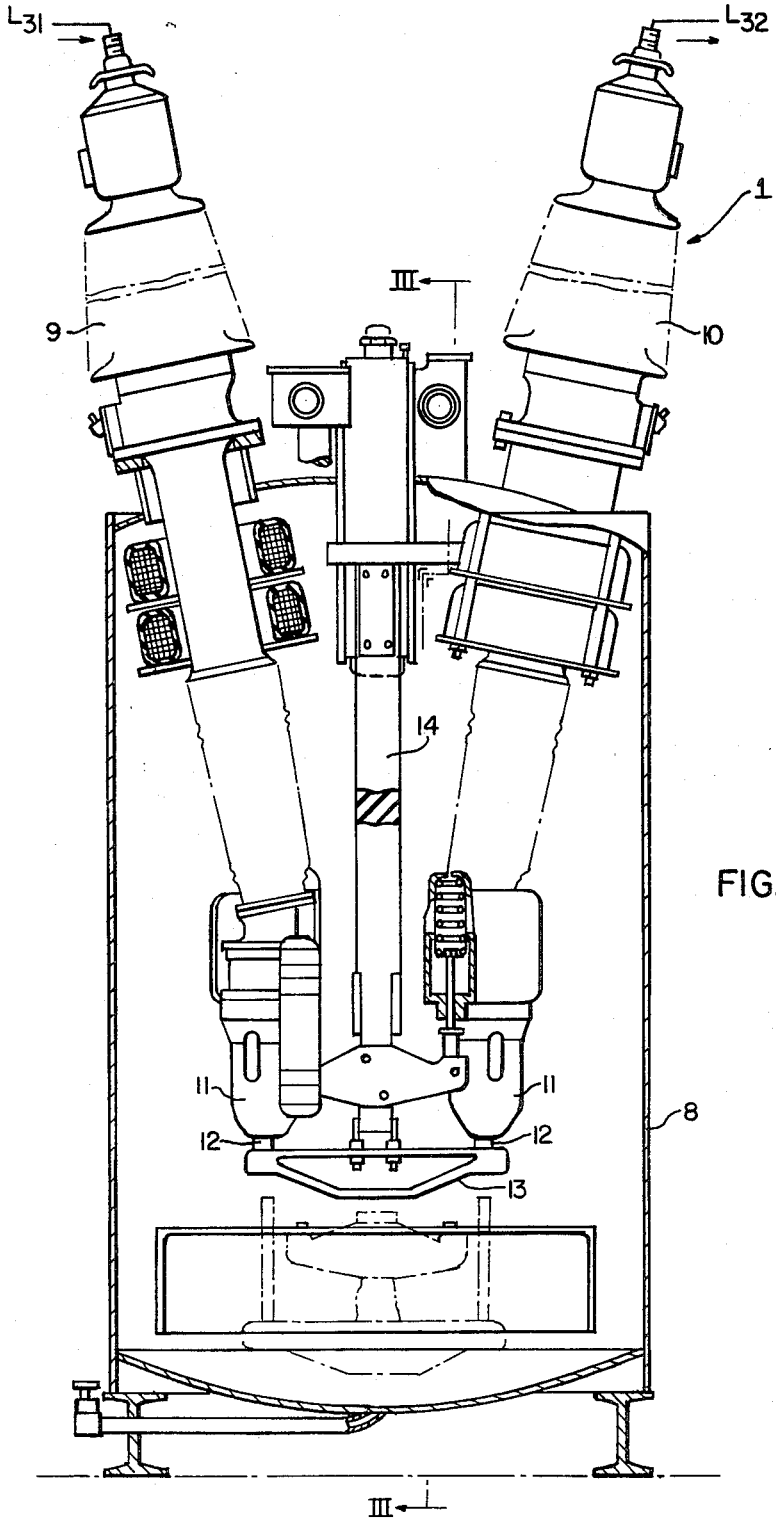
FIG. 2 is a vertical sectional view taken through the end tank structure of FIG. 1, specifically showing an oil-type, high-power circuit breaker; the contact structure being illustrated, however, in the closed-circuit position with the open position shown in broken line.
Figure 3:
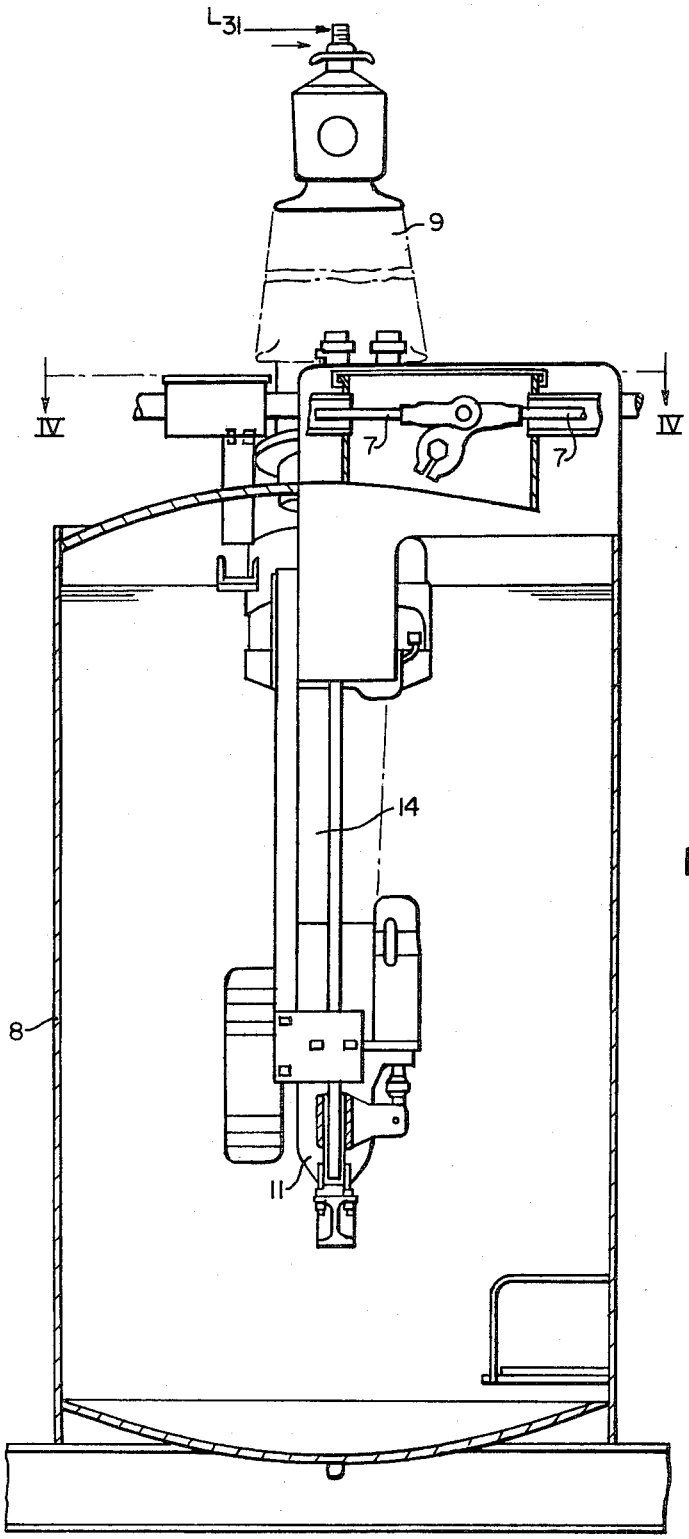
FIG. 3 is a vertical sectional view taken substantially along the line III—III of FIG. 2.
Figure 4:
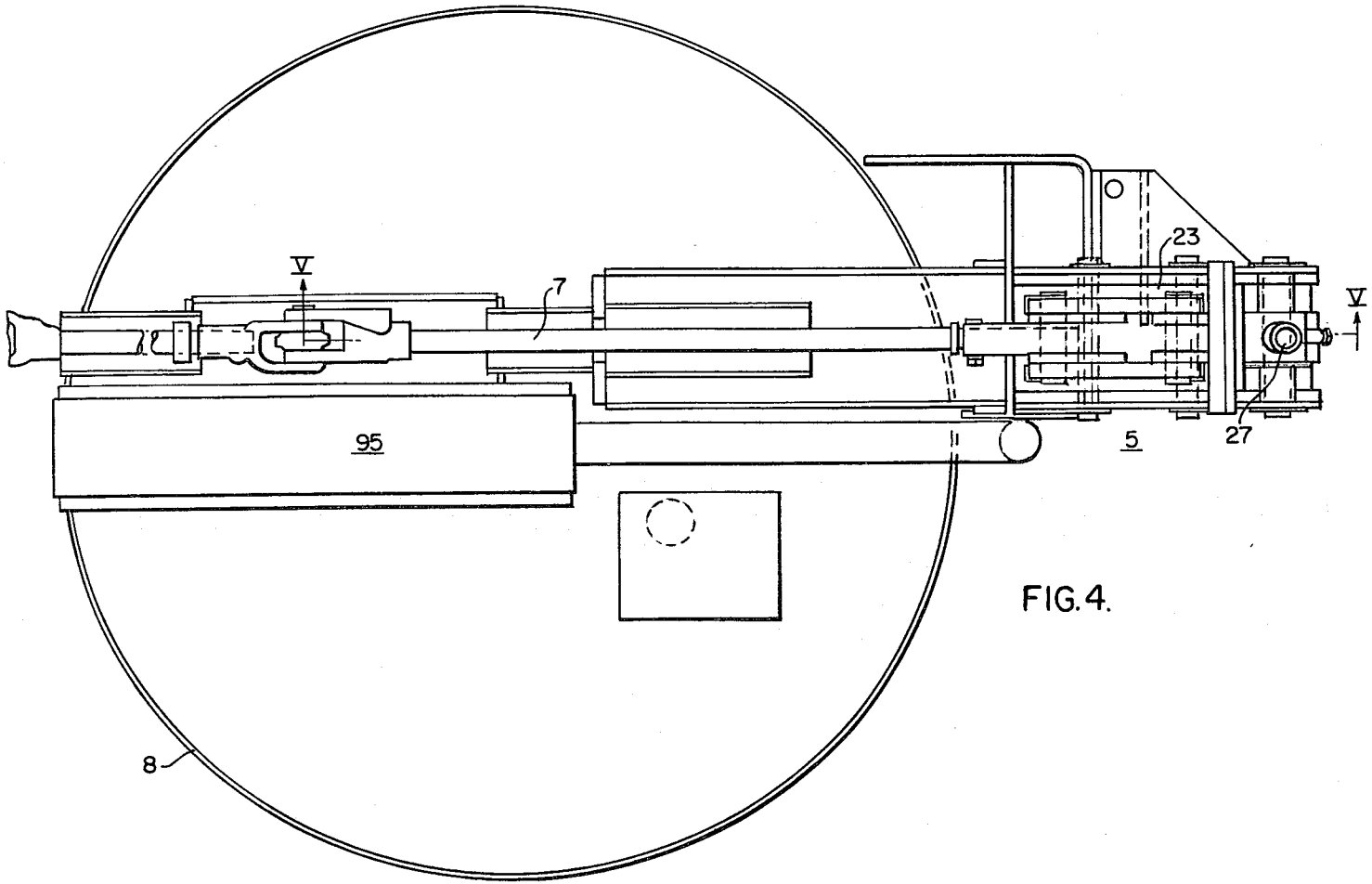
FIG. 4 is a plan view of the circuit breaker structure of FIGS. 2 and 3, taken along the line IV—IV of FIG. 3 and including the toggle linkage.

An upright grounded metallic tank 8 (FIGS. 2, 3) supports terminal bushings 9, 10 the lower ends of which each support similar stationary contacts 11 which cooperate with movable contacts 12. The movable contacts 12 are electrically interconnected by a horizontal bridge 13 which is actuated vertically by an insulating lift rod 14. For closing the contacts 11, 12 a mechanical linkage 15 extending from the closing mechanism to the operating means 7 lifts the three lift rods 14. Similarly, the opening mechanism 5 is connected to the operating means 7 by a mechanical linkage 16 (FIG. 1).

As shown in FIG. 1 the stationary contacts 11 are supported by similar conductors 17 which depend from spaced terminal bushings 9, 10 at the upper end of each pole unit 2, 3, and 4. The upper ends of the terminal bushings are electrically connected to transmission-line circuits $L_1$–$L_2$, $L_{21}$–$L_{22}$, and $L_{31}$–$L_{32}$ of the three-phase circuit breaker 1.

The opening mechanism 5 (FIGS. 1, 5, 6) comprises a cylinder 20 and piston 21 together with a piston rod 22.

Figure 5:
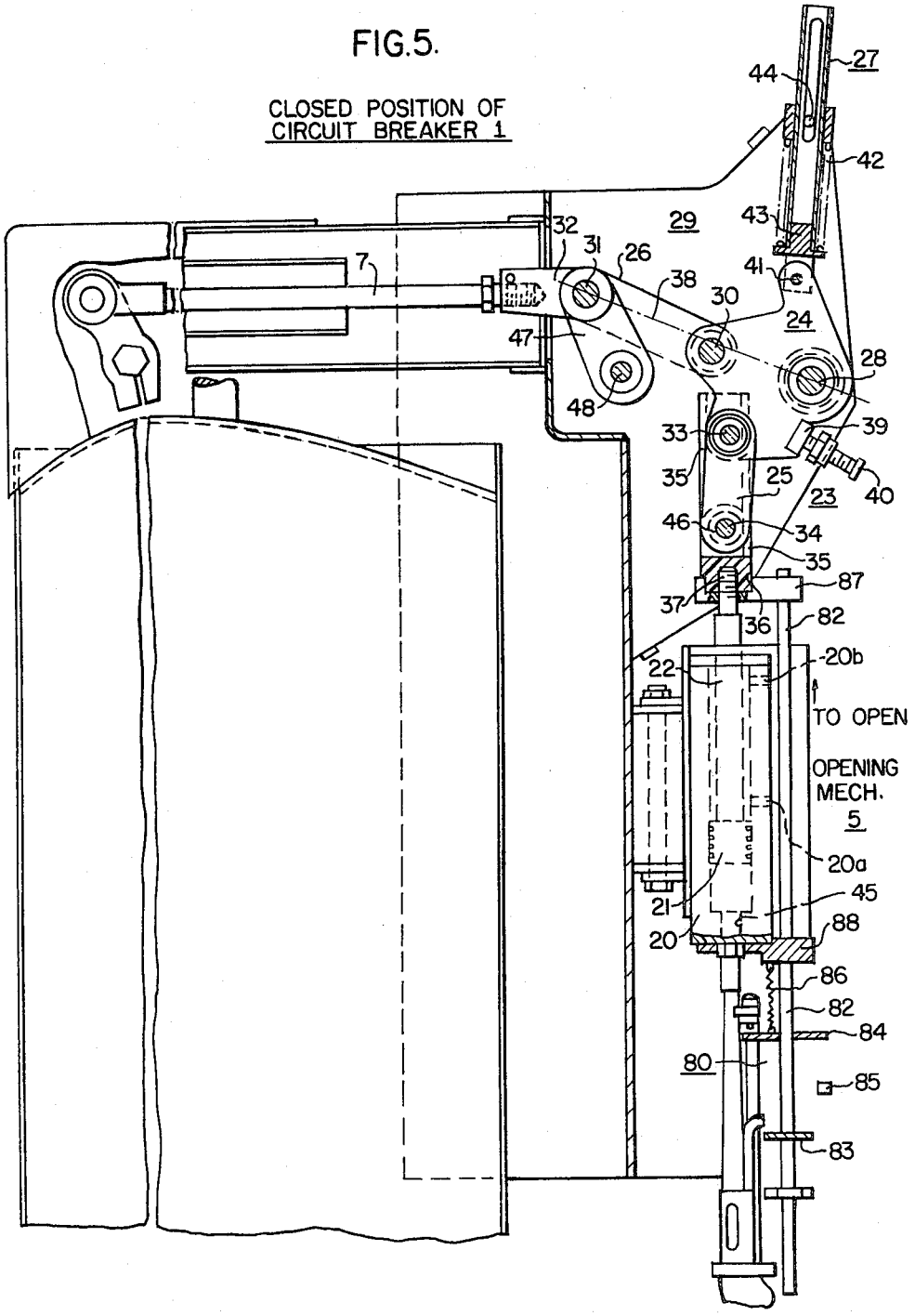
FIG. 5 is a fragmentary vertical sectional view taken substantially along the line V—V of FIG. 4, and illustrating the fully closed circuit position.
Figure 6:
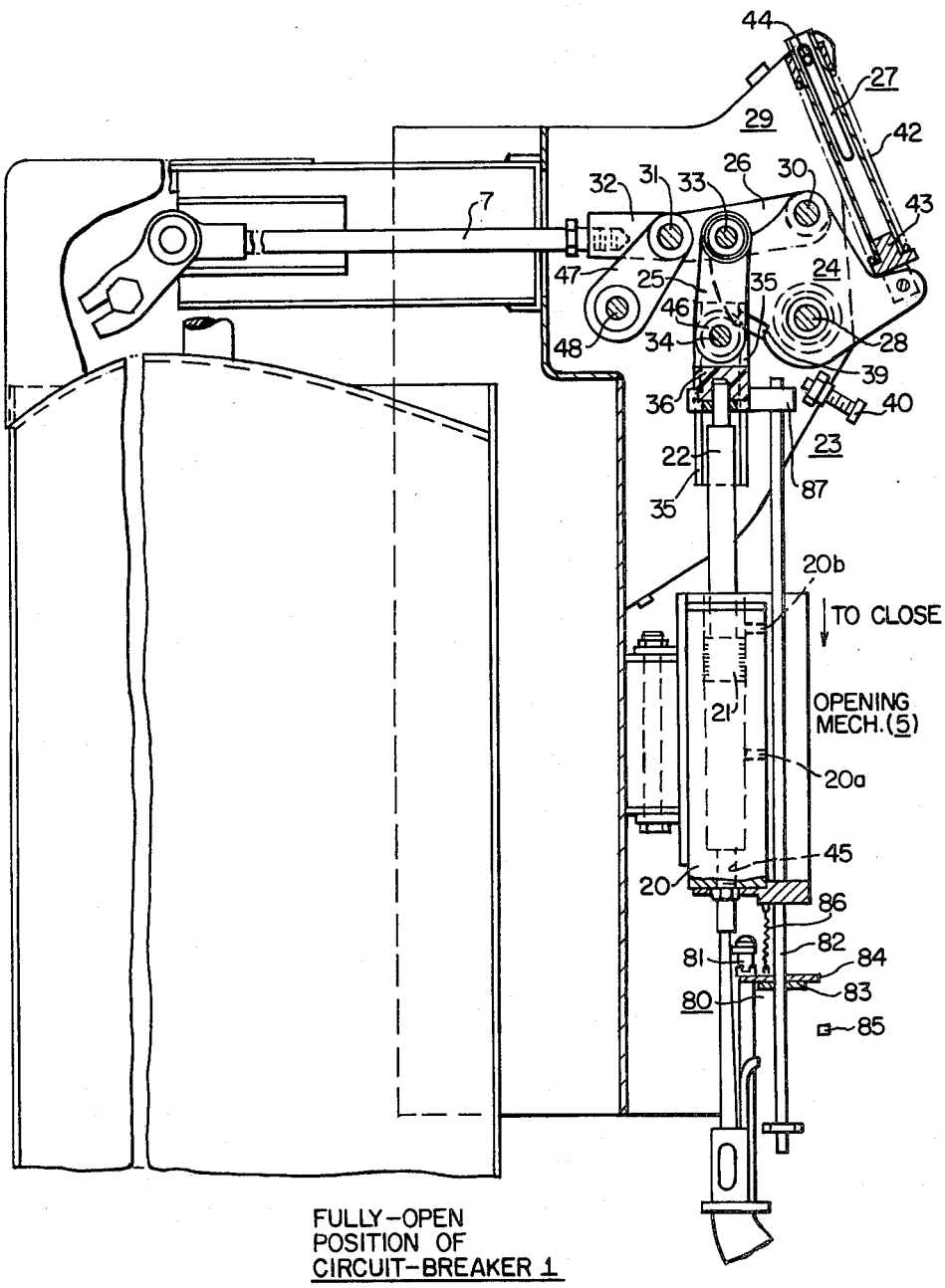
FIG. 6 is a fragmentary sectional view similar to that of FIG. 5, but illustrating the position of the several component parts in the fully open circuit position.

A toggle linkage assembly 23 connects the piston rod 22 to the operating means 7 and the assembly comprises a toggle lever 24, a drive link 25, a toggle link 26, and an over-center biasing spring assembly 27. The toggle lever 24 is pivotally mounted on a pin 28 which extends between and is mounted on a pair of spaced frames, one of which frame 29 is shown in FIGS. 5, 6. The toggle link 26 is pivotally connected by a pin 30 to the toggle lever at one end and by a pin 31 to a coupling 32 at the end of the operating means for rod 7. Likewise the drive link 25 is pivotally connected at 33 at one end to the toggle lever 24. The lower end of the drive link 25 includes a pivot pin 34 which is movably connected to a coupling 36 to which the upper end of the piston rod 22 is attached at 37. The pin 34 has rollers 46 at each end which are guided in their travel by a set of parallel guides 35 in the frames 29.

In the closed position of the contacts (FIGS. 2, 20) the toggle linkage assembly 23 is disposed in the position shown in FIG. 5 with the axis of the pin 30 in a toggle latched position below a line 38 extending through the axes of the pins 28, 31. In that position the piston 21 is in a lower portion of the cylinder 20 and the pin 34 is at the lower end of the space between the guides 35. Thus, the toggle lever 24 is in an over-center, or overset toggle position, with the toggle plate resting at 39 against an adjustable stop screw 40. To help move the toggle lever 24 to that position the biasing spring assembly 27 applies a counterclockwise force at a pivot pin 41, to the lever 24 and comprises a toggle biasing spring 42 which is compressed between a spring cap plug 43 and a mounting mechanism having a pin 44. The contacts 11, 12 are opened (FIG. 1) by the transmission of a sudden expulsion of a gas medium through an opening 45 into the cylinder 20 for driving the piston 21 to the upper position (FIG. 6) for rotating the toggle lever 24 clockwise until the axis of the pivot pin 30 is above the line 38. For that purpose the pin 34 which is encased within a roller 46 moves upwardly to the position shown (FIG. 6) between the guides 35. As the operating means 7 moves to the right, the coupling 32 and the toggle link 26 are guided by a guide link 47 the lower end of which is pivoted at 48. Accordingly, the contacts 11, 12 are opened by operation of the toggle linkage assembly 23.

Figure 7:
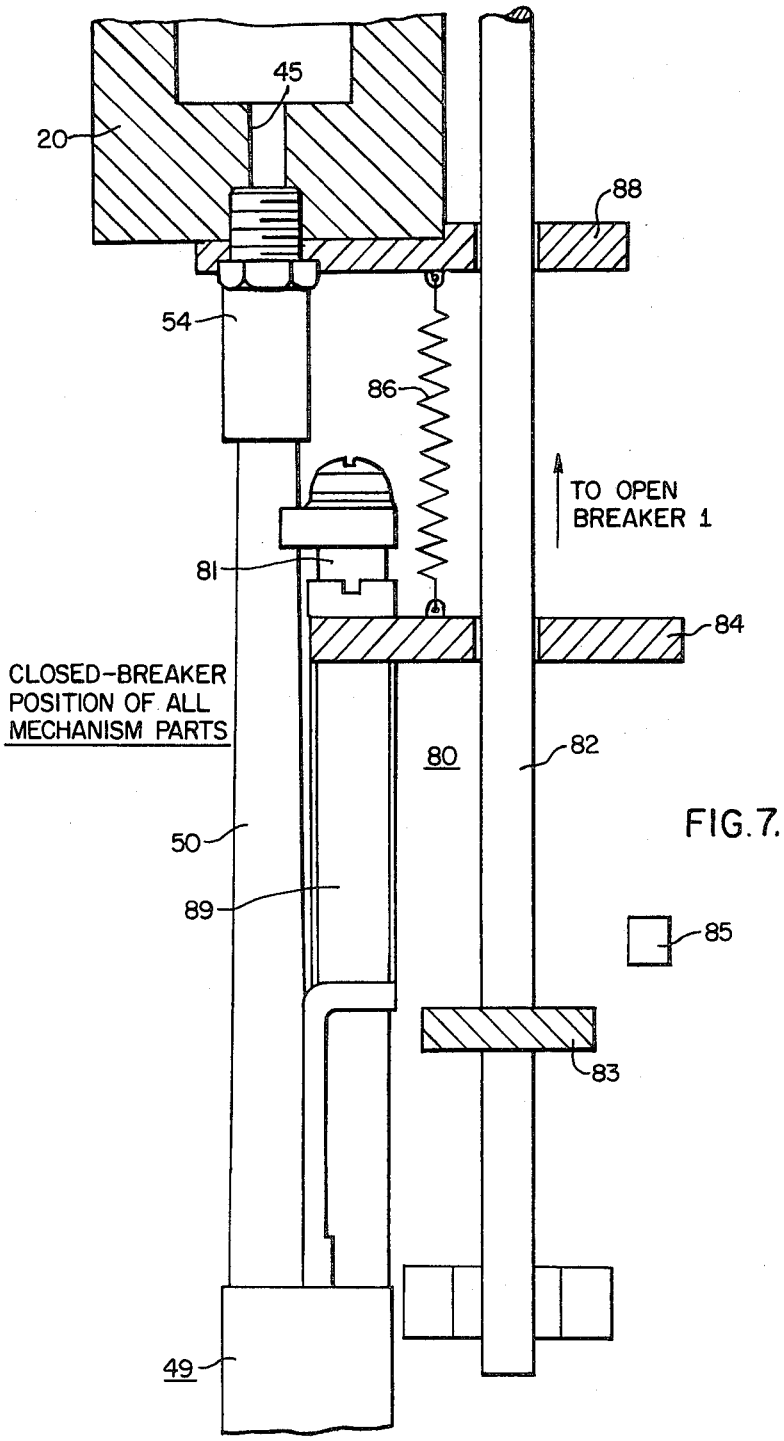
FIG. 7 is an enlarged vertical sectional view of the propellant-reloader actuator or motivator with parts illustrated in the breaker closed circuit position, and in position for a subsequent opening, tripping operation of the circuit breaker.
Figure 8:
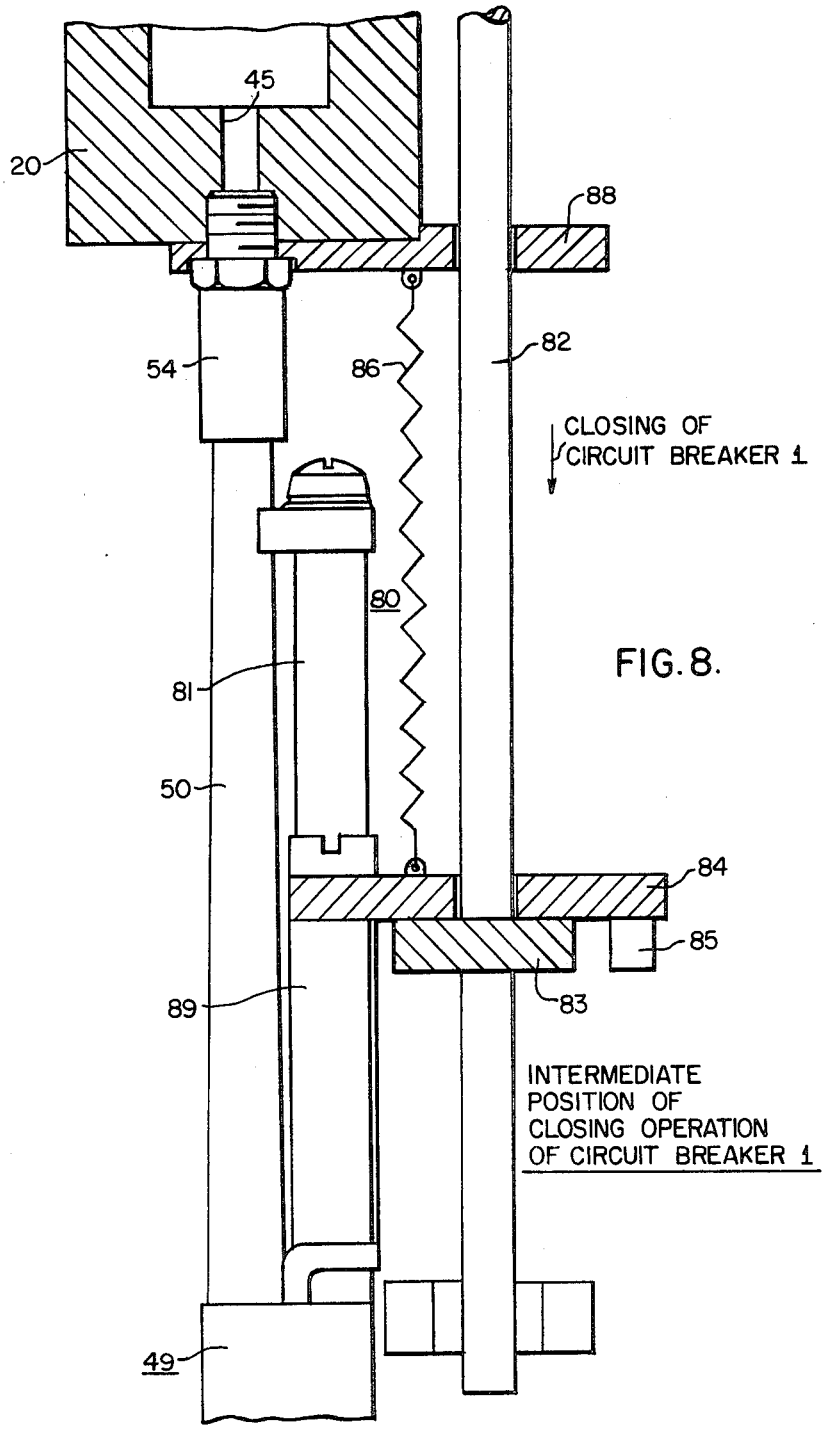
FIG. 8 is a view similar to that of FIG. 7, but illustrating the position of the several parts at an intermediate position of the closing operation of the circuit breaker, and just prior to an unlatching of the ejector-and-reloading mechanism.
Figure 9:
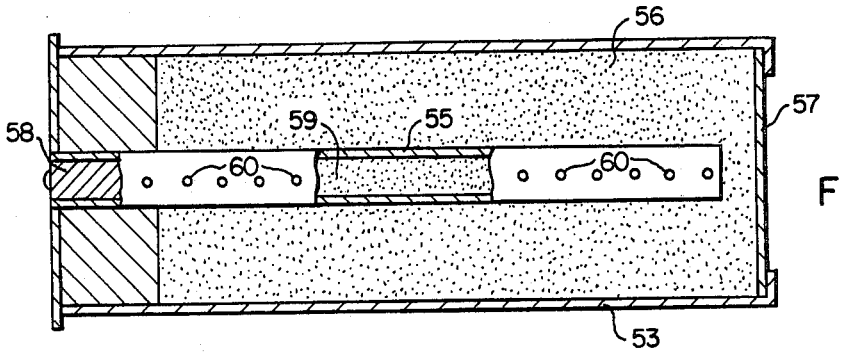
FIGS. 9 and 10 are enlarged vertical sectional views of two embodiments of the propellant shotgun-type, cartridges which may be used as the motivating driving means.

The piston 21 is driven upwardly in the circuit breaker opening direction by a sudden expulsion of gaseous medium generated by a gas generator, such as a "shotgun"-type modified from a shotgun 49 (FIG. 11) having a barrel 50, a firing chamber 51 and a firing pin 52 modified for firing electrical primers for firing a cartridge 53 containing a propellant charge. As shown more particularly in FIGS. 7 and 8 the modified shotgun 49 is secured by a nipple 54 to the lower end of the cylinder 20 in alignment with the opening 45. One embodiment of the cartridge 53 (FIG. 9) comprises a tube 55 containing igniter material centrally disposed within the cartridge and surrounded by a propellant 56 which is retained within the cartridge by an end cap 57. When a primer 58 is energized by the electrical firing pin 52 and igniter material within the tube 55 ignites and is ejected through a plurality of apertures 60 in the tube 55 to ignite the gunpowder 56, whereupon high pressure gasses are generated and communicated to the cylinder 20 to drive the piston 21 upwardly to the position shown in FIG. 6. At the appropriate position exhaust vents 20*a* are provided to vent the high pressure gasses and provide the desired continuation of the stroke. The vents with the mechanical ratio system provide control of the energy from the propellant charge. The vent location and size is determined by the needed travel characteristics. In addition, vents 20*b* are provided to prevent a closed volume under the piston being formed, which could hinder or affect operation.

Figure 10:
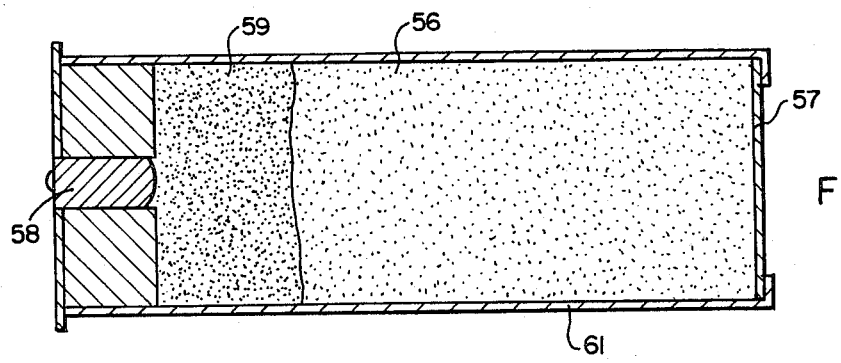

Another embodiment of the cartridge is a cartridge 61 (FIG. 10) in which the cartridge, devoid of the tube 55 is first charged with a portion of igniter material 59 adjacent the primer 58 and then charged with the gunpowder 56. For both embodiments of the cartridge 53, 61 the igniter 59 is a readily ignited material, such as black powder, a mixture of amorphous boron powder and potassium nitrate, smokeless powder, or other suitable compounds.

Where it is preferred to use an electric initiation instead of a conventional firing pin of the type used in the shotgun 49, a cartridge 62 (FIG. 12) is used which comprises charges of gunpowder 56 and igniter 59 as well as a primer 63. The primer 63 contains a thermally sensitive, flammable mixture such as lead styphnate and acetylene black which is ignited to produce a small flame to ignite the igniter 59 which in turn produces a flame for igniting the propellant 56. Thus, to trip the circuit interrupter system 1 to the open contact position an electric circuit 69 having a source 70, such as a battery, conductors 71, 72 and a switch 73, is closed to complete a circuit through a conducting firing pin 74 which is in electrical contact with the primer 63 and the cartridge 62 which in turn is in contact with metal members 51, 75 to which the conductor 71 is attached.

Figure 12:
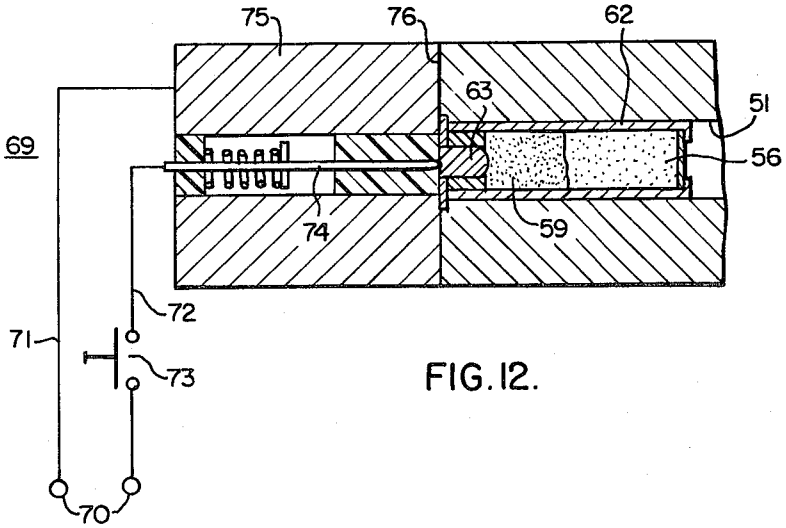
FIG. 12 is a fragmentary sectional view illustrating an electrical circuit which may be used to initiate electrical firing of the primer associated with the shotgun-shell type of propellant cartridge.
Figure 13:
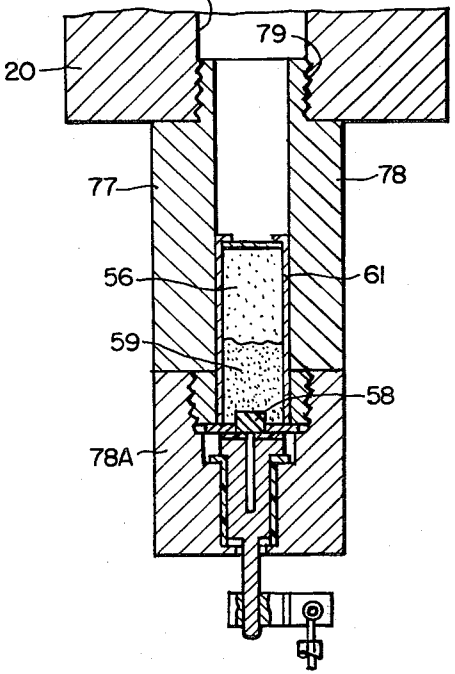
FIG. 13 is a sectional view of a single shot-type of motivating power device by which non-repetitive action is provided and in which manual reloading may be utilized, and the Figure being a vertical sectional view taken through an alternate end-cap structure which may alternatively be secured to the lower end of the operating power cylinder.
Figure 15:
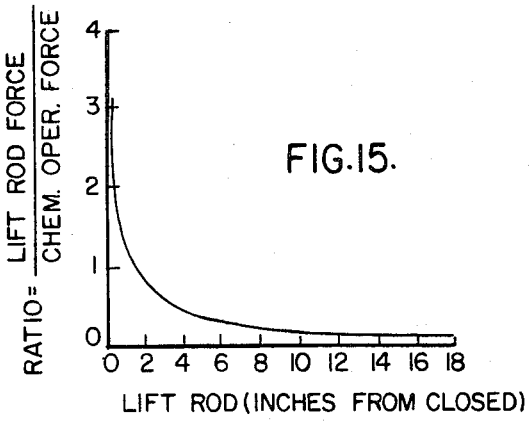
FIG. 15 is a graph of the ratio of the lift-rod force to the chemical-operator force as a function of contact position.
Figure 16:
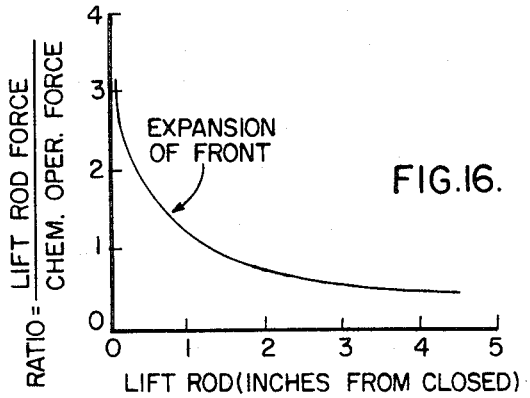
FIG. 16 is a graph showing an expansion of FIG. 15.

The cartridge construction shown in FIG. 12 also comprises a conducting break surface 76 by which the metal member 75 is separated from the end of the firing chamber 51 and the cartridge 62. Such construction is conducive to automatic ejection and reloading of the cartridge 62 for repetitive operations, in the conventional sporting arms manner.

Where manual reloading of a cartridge is preferred a cartridge firing device 77 (FIG. 13) is provided. A single cartridge 61 is inserted in a firing chamber 78 which is preferably manually screwed in place at 79. The firing means included in an end cap 78*a* is then attached. Firing means is connected thereto.

The cartridge is fired, the initial part of the motion of the toggle linkage assembly 23 is from overtoggle position and across the toggle latch line 38 the breaker opening operation commences. The mechanical ratio is set up so that in the early stages of the opening stroke, there is considerable movement of the piston 21 and comparatively little movement of the movable contacts 12. This is to obtain the correct mechanical ratio to develop very high forces and high accelerations in the early stages of the stroke. Thus, a contact-part position is attained in a very short period of time (FIG. 14). A desired characteristic for use with an oil-breaker is to maintain the same velocity-time characteristics through the interrupting zone (A) (FIG. 14), namely, that region from when the contacts part and arcing begins until the breaker interrupts and arcing ceases.

Figure 19:
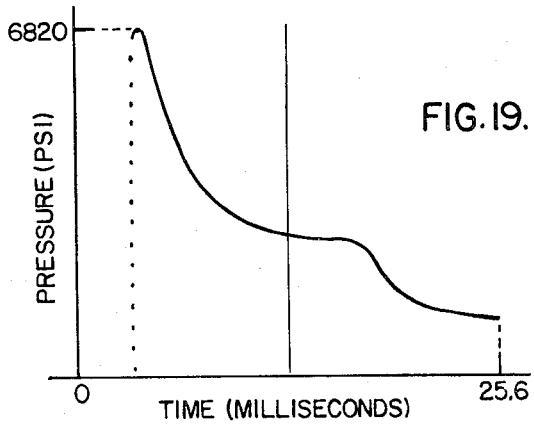
FIG. 19 is a time-pressure curve obtained from an actual chemical operator test.

In that regard two considerations are involved namely, contact part time and interrupting time. The contact part time is the time from the initiation of the trip signal to the time the contacts separate. The interrupting time is the time elapsing between the initiation of the trip signal and the interruption of the arc. The interrupting, or arcing zone, is the difference between the interrupting time and the contact part time. The opening mechanism and associated linkage system do not change the characteristics through the interrupting or arcing zone (A) of FIG. 14. However, it does permit the contact-part to be reached in a much shorter period of time for two reasons. First, it reduces the "dead" time which is the time from energization of the trip circuit until motion begins, because response time of a propellant cartridge is much faster than normal devices presently used on oil breakers. Second, it reduces contact-parttime by having a higher acceleration from start of motion for the first stages of the opening stroke until such time the desired velocity is obtained, at which time the travel will blend into the normal travel curve, which is obtained in the normal spring-open oil breaker. The normal oil-circuit-breaker requires approximately 18 milliseconds time from energization of the trip coil through the unlatching procedure of the mechanism until the circuit breaker actually begins its opening motion. The cartridge-type operation reduces time to approximately 4 milliseconds. A time pressure curve (FIG. 19) shows that test records indicate the peak pressure is obtained in approximately 1 millisecond from the start of pressure. The time required to initiate combustion is less than a millisecond using the spark-gap type of electrical primer, or the hot-wire type with increased voltage. This gives a total time to peak pressure of approximately 2 milliseconds, at which time the motion is under way.

Figure 11:
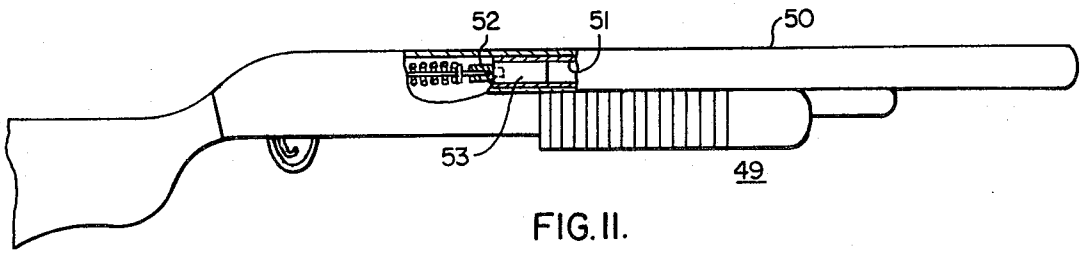
FIG. 11 is a side elevational view, partially in section, of a repeating-type of pump-action shotgun having a tubular magazine therefor, and the firing pin location being shown to illustrate with more clarity the propellant, actuator device utilized in connection with the instant invention.
Figure 17:
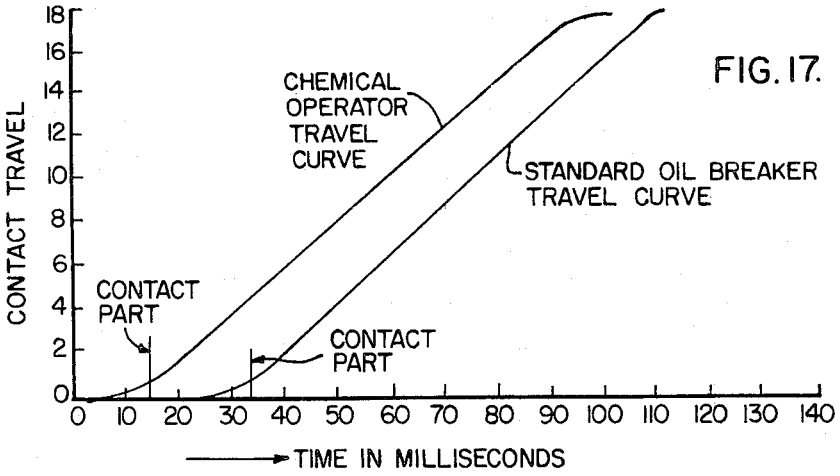
FIG. 17 is a graph of the comparison of the opening characteristics of the propellant-operated breaker as contrasted with the opening characteristics of a breaker operated in a normal manner using a standard unlatching mechanism and spring energy.

Once motion has begun it takes the normal oil circuit breaker which is spring opened approximately 15 milliseconds from the time the motion begins to reach contact part, as compared with as little as 7 milliseconds from the start of the motion to reach contact part by the structure of this invention. The reduction is due to the linkage system and ratio thereof, allowing higher accelerations during the early part of the stroke followed by a decrease of acceleration as contact part is approached. Thus, initial "dead" time is reduced as shown in FIG. 17.

Where a modified shotgun 49 is used it is convenient to employ a pump-type, reloading shotgun having a movable slide or ejector mechanism 80 disposed around a magazine tube 81 in which a plurality of new cartridges 53 are stored in an end-to-end arrangement. To eject a used cartridge 53 (FIG. 11) and to reload a new cartridge, the ejector mechanism 80 comprises an operating rod 82, a permanent magnet 83, a magnetic plate 84, a stop 85, and a tension spring 86. The upper end of the operating rod 82 (FIG. 5) is secured by a clamp 87 to the upper end of the piston rod 22 whereby the rod is movable with the piston. The lower portion of the rod 82 extends through a support bracket 88 at the lower end of the cylinder 20 and through the plate 84. The magnet 83 is fixedly mounted on the lower end portion of the rod 82. In the closed breaker position of the circuit interrupter system 1 the ejector mechanism 80 is disposed in the position shown in FIGS. 5, 7 with the magnet 83 below the stop 85. When the opening mechanism 5 moves to the open position of the circuit interrupter system 1, the piston rod 22 is in the uppermost position (FIG. 6) and the magnet 83 abuts the plate 84 (FIG. 6). Subsequently, when the closing mechanism 6 returns the contacts 12 to the closed position with the stationary contact 11, the piston rod 22 is lowered whereupon (FIG. 8) the magnet 83 pulls the magnetic plate 84 downwardly and an ejector pump slide 89 with it, causing ejection of the cartridge 53 from the firing chamber 51 (FIG. 11). Continued movement of the operating rod 82 downwardly as the piston rod is further retracted into the cylinder 20, causing the magnet 83, the plate 84 to separate because the plate 84 strikes the stop 85 and overcomes the magnetic force between the magnet 83, the plate 84. The tension spring 86 then returns the plate 84 to its original position and the ejector pump slide 89 with it whereby an unused cartridge is inserted into the firing chamber.

Figure 18:
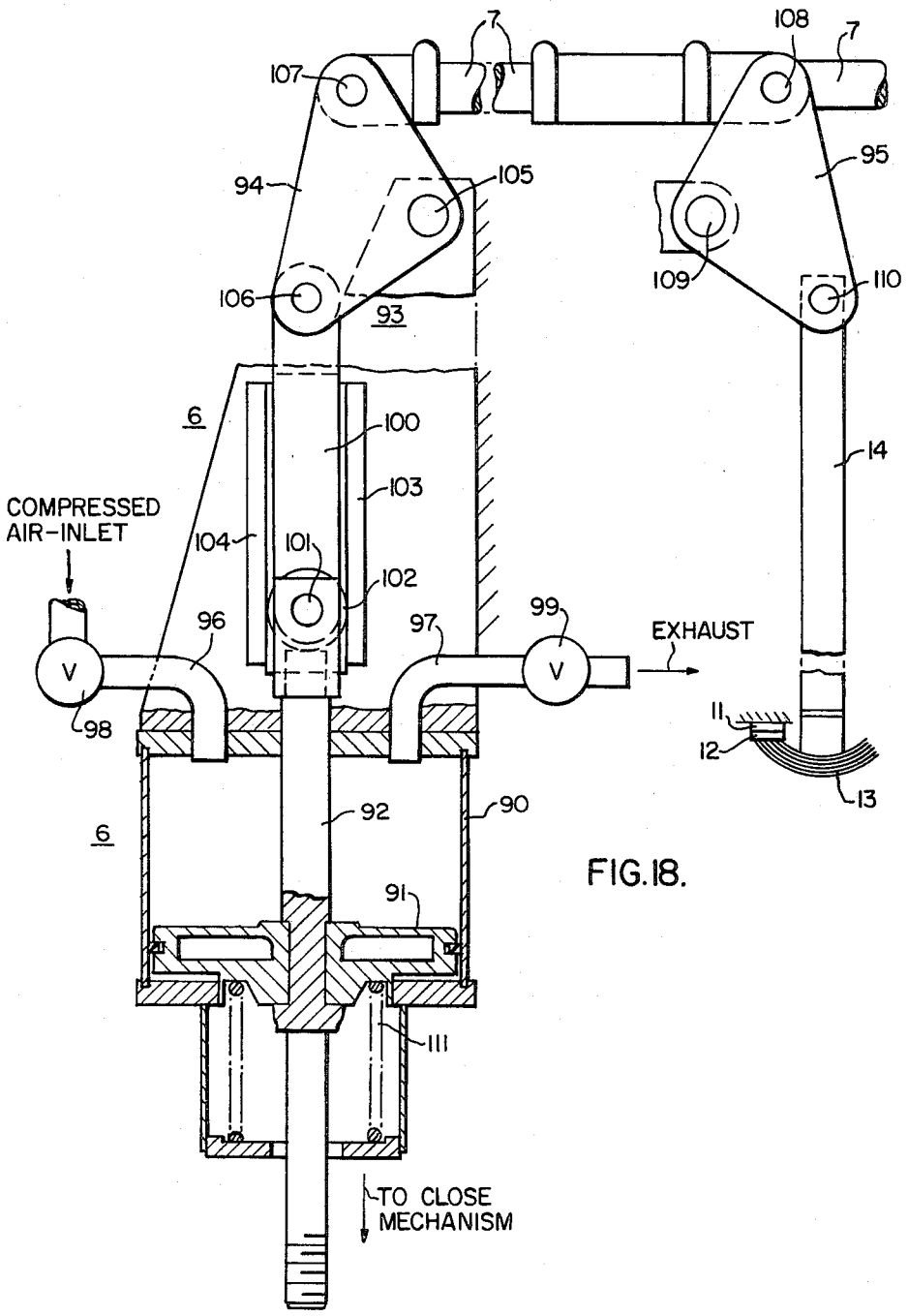
FIG. 18 is a fragmentary vertical sectional view of the mechanism for closing the contacts of the circuit breaker.

The closing mechanism 6 (FIG. 18) comprises a pneumatic cylinder 90, a piston 91, a piston rod 92, and a linkage assembly generally indicated at 93. The linkage assembly 93 comprises a bell-crank lever 94, the operating means or rod 7, a bell-crank lever 95 (FIG. 1), and the lift rod 14.

Compressed air inlet and outlet 96, 97 communicate with the cylinder chamber above the piston 91. Similar valves 98, 99 which are preferably solenoid-operated valves, function with the respective inlet and outlets 96, 97 for opening and closing air passage into and out of the cylinder chamber. The upper end of the piston rod 92 is secured to a link 100 by a pin 101. Rollers 102 are mounted on the pin for guiding vertical movement of the lower end of the link in a slot between guideways 103, 104. The bell-crank lever 94 is pivotally mounted on a pin 105 and the upper end of the link 100 is pivotally attached by a pin 106 to the lever 94.

Opposite ends of the operating means for rod 7 are secured by pivot pins 107, 108 between the bell-crank levers 94, 95 the latter of which is pivotally mounted by a pin 109. The upper end of the link rod 14 is pivotally mounted at 110 of the bell-crank lever 95.

In operation, to close the contacts 11, 12, the solenoid valve 98 is opened and the valve 99 is closed to enable compressed air from a storage reservoir (not shown) to drive the piston 91 downwardly within the cylinder 90 and against a piston retrieving spring 111. During that operation the toggle linkage assembly 23 is returned to the overtoggle closed position (FIG. 5) for holding the contacts in the closed circuit condition, whereupon the valve 98 (FIG. 18) may be returned to a normally closed position and the valve 99 may be returned to a normally open position exhausting the compressed air so that spring 111 is free to lift the piston 91 when the contacts are subsequently opened.

In conclusion, the device of this invention provides for opening and closing a power circuit breaker in a positive and effective manner. Device has been described for a particular application but can readily be used on breakers of any type or rating or even other mechanical devices. A magnetic reloader latching scheme is described but could be easily a mechanical latching scheme and in fact was testing with a mechanical latch.

What is claimed is:

1. A circuit interrupter comprising a pair of separable contacts, operating means connected to the contacts for opening the contacts including a toggle lever pivotally mounted for movement between positions corresponding to closed and open conditions of the separable contacts, closing means for closing the contacts including a cylinder-piston assembly and having a piston rod operatively connected to the separable contacts, the closing means being interconnected to the toggle lever to effect latching of the contacts in the closed condition, firing chamber means for directing a propellant force into the cylinder and against the piston, propellant charge-containing cartridge removably mounted in the firing chamber means, the firing chamber means having pump slide means reciprocally movable for inserting and ejecting cartridges into and from the firing chamber means, ejector mechanism for moving the pump slide means and comprising an operating rod operatively attached to the piston rod, a magnetic member fixedly mounted on the operating rod, a magnetic-responsive plate fixedly mounted on the pump slide means and extending into the path of travel of the magnetic member, spring means for maintaining the ejector mechanism in the cartridge-inserted position, the operating rod being movable with the piston rod to an extended position to effect contact of the magnet with the magnetic-responsive plate, and the operating rod being retractable with the piston rod to effect movement of the pump slide means to the cartridge-ejected position.

2. The circuit interrupter of claim 1 in which stop means are located in the path of travel of said plate for releasing said plate from the magnetic influence of the magnetic member.

3. The circuit interrupter of claim 2 in which the ejector mechanism includes spring bias means for returning the plate to the cartridge-inserted position.

4. The circuit interrupter of claim 1 in which the means for closing the contacts comprises a cylinder-piston assembly including an interconnected linkage mechanism.

5. The circuit interrupter of claim 4 in which an operating mechanism is operatively connected between the separable contacts and the cylinder-piston assembly.

6. The circuit interrupter of claim 5 in which the operating mechanism includes a lever operatively connected to the cylinder-piston assembly.

7. A circuit interrupter of claim 1 in which a linkage extends between the contacts and the toggle lever and is connected to bias the toggle lever in the latched position, the piston rod being operatively connected to the toggle lever to turn the toggle lever from the latched to the unlatched position, and means for closing the contacts.

8. The circuit interrupter of claim 6 in which the piston rod and piston assembly when actuated turning the toggle lever over center to the unlatched position.

9. The circuit interrupter of claim 7 in which an overcenter toggle-spring assembly is attached to the toggle lever for biasing the lever toward the latched position.

* * * * *